US008128806B2

(12) United States Patent
Baptista et al.

(10) Patent No.: US 8,128,806 B2
(45) Date of Patent: Mar. 6, 2012

(54) PROCESS AND EQUIPMENT FOR FLUID CATALYTIC CRACKING FOR THE PRODUCTION OF MIDDLE DISTILLATES OF LOW AROMATICITY

(75) Inventors: Claudia Maria de Lacerda Alvarenga Baptista, Rio de Janeiro (BR); Edisson Morgado Junior, Rio de Janeiro (BR); William Richard Gilbert, Rio de Janeiro (BR)

(73) Assignee: Petroleo Brasileiro S.A.—Petrobras, Rio de Janeiro (BR)

( * ) Notice: Subject to any disclaimer, the term of this patent is extended or adjusted under 35 U.S.C. 154(b) by 504 days.

(21) Appl. No.: 12/358,462

(22) Filed: Jan. 23, 2009

(65) Prior Publication Data

US 2009/0188835 A1 Jul. 30, 2009

(30) Foreign Application Priority Data

Jan. 24, 2008 (BR) ..... 0800236

(51) Int. Cl.
*C10G 11/04* (2006.01)

(52) U.S. Cl. ..... 208/113; 208/114; 208/118; 208/122; 208/123

(58) Field of Classification Search ..... 208/113–124
See application file for complete search history.

(56) References Cited

U.S. PATENT DOCUMENTS 3,691,099 A * 9/1972 Young ..... 502/62
(Continued)

FOREIGN PATENT DOCUMENTS

WO WO 93/22400 11/1993
WO WO 2007/082629 7/2007

OTHER PUBLICATIONS

Gary, J.H. et al. (2007). Petroleum Refining Technology and Economics, 5th ed. CRC Press, 465 pgs.*

(Continued)

*Primary Examiner* — Robert J Hill, Jr.
*Assistant Examiner* — Brian McCaig
(74) *Attorney, Agent, or Firm* — Nixon & Vanderhye P.C.

(57) ABSTRACT

The present invention relates to a process and equipment for fluid catalytic cracking for the production of middle distillates of low aromaticity that comprises cracking a mixed feed consisting of heavy fractions of hydrocarbons, in the absence of added hydrogen and employing a catalyst of low activity and low acidity, in a dense-bed FCC reactor to produce an effluent constituted of fractions of middle distillates and naphtha of low aromaticity.

7 Claims, 3 Drawing Sheets

U.S. PATENT DOCUMENTS

| | | | | | |
|---|---|---|---|---|---|
| 4,764,268 | A | | 8/1988 | Lane | |
| 4,818,372 | A | | 4/1989 | Mauleon et al. | |
| 4,875,994 | A | * | 10/1989 | Haddad et al. | 208/113 |
| 5,087,349 | A | | 2/1992 | Goelzer et al. | |
| 5,248,408 | A | * | 9/1993 | Owen | 208/113 |
| 5,389,232 | A | | 2/1995 | Adewuyi et al. | |
| 5,665,949 | A | | 9/1997 | Fusco et al. | |
| 5,954,924 | A | | 9/1999 | Art | |
| 6,416,656 | B1 | | 7/2002 | Zhang et al. | |

OTHER PUBLICATIONS

Daniell, W. et al. (2001). Langmuir, 17, 6233-6239.*

Kladnig, W. (1976). The Journal of Physical Chemistry, 80(3), 262-269.*

Hydrocarbon Publishing Company, "Advanced Hydrotreating and Hydrocrack ng Technologies to Produce Ultra$^2$-Clean Diesel Fuel", pp. VII-22-VII-441, Jan. 2004 (Author not indicated).

Peterman, "Distillate Yield from the FCCU: Process and Catalyst Changes for Maximization of LCO", Catalysts Courier, pp. 6-10, Apr. 1998.

Pohlenz et al., "New Development Boosts Production of Middle Distillate from FCC", Oil and Gas Journal (Aug. 1970), pp. 158, 163-165.

Zhang et al., "Studies on Maximizing Diesel Oil Production from FCC", Fifth International Symposium on the advances in fluid catalytic cracking, (218$^{th}$ National Meeting, American Chemical Society, 1999), pp. 457-459.

* cited by examiner

PROCESS AND EQUIPMENT FOR FLUID CATALYTIC CRACKING FOR THE PRODUCTION OF MIDDLE DISTILLATES OF LOW AROMATICITY

This application claims priority to Brazil Application No. PI 0800236-3 filed 24 Jan. 2008, the entire contents of each of which are hereby incorporated by reference.

FIELD OF THE INVENTION

The present invention relates to a process and equipment for fluid catalytic cracking (FCC), for the production of middle distillates of low aromaticity, in the absence of added hydrogen, from heavy hydrocarbon feedstocks of various origins.

The invention further relates to FCC equipment for the production of the above products.

BACKGROUND OF THE INVENTION

The purpose of the FCC process is to convert liquid hydrocarbons of high molecular weight, which generally have an Initial Boiling Point (IBP) in the range from 320° C. to 390° C., or higher, and typical densities in the range from 8 to 28° API, such as oil refinery effluents produced from side cuts from vacuum towers, called heavy vacuum gas oil (HVGO), or from the bottom of atmospheric towers, called atmospheric residue (ATR), or mixtures of these effluents, to light hydrocarbon fractions such as gasoline (IBP around 30° C.) and liquefied petroleum gas (LPG) (maximum vapour pressure of 15 kgf/cm$^2$ at 37.8° C.).

The stages of the FCC process are well known by a person skilled in the art and are described in various patent documents. The process described in Brazilian patent PI 9303773-2 is considered to be particularly important, and is incorporated in its entirety as reference.

Despite the long existence of the FCC process, there is a constant search for ways of improving the process, by increasing the production of derivatives of greater added value; such as gasoline and LPG. In general, it can be said that the main aim of the FCC processes is maximization of the output of these higher-value derivatives.

Maximization of said higher-value derivatives is obtained, basically, in two ways. Firstly, by increasing the so-called "conversion", which corresponds to reduction of the output both of heavy products (clarified oil), and of light cycle oil (LCO). Secondly, by lowering the yields of coke and fuel gas, i.e. by lower "selectivity" of the process with respect to said higher-value derivatives.

The lower output of fuel gas and coke, on increasing the selectivity of the process for LPG and gasoline, has as additional beneficial consequences, the use of smaller air blowers and wet gas compressors, large machines with high energy consumption, in general limiting the capacity of the FCC units. Moreover, it is economically advantageous to promote increases in products of higher added value.

An important aspect to consider is the possible benefit or need to increase the production of LPG in accordance with the refiner's needs.

It is well known by a person skilled in the art that an important aspect of the process is the initial contact of the catalyst with the feed, which has a decisive influence on the conversion and the selectivity of the process by generating high-value products. In the FCC process, the preheated hydrocarbon feed is injected near the bottom of a conversion zone or "riser", where it comes in contact with the stream of regenerated catalyst, from which it receives a sufficient amount of heat to vaporize it and supply the requirements of the endothermic reactions that predominate in the process.

After the riser, which is a long vertical pipe having dimensions in industrial units of about 0.5 m to 2.0 m in diameter, with a height of 25-40 m, where chemical reactions take place, the spent catalyst, with coke deposited on its surface and in its pores, is separated from the reaction products and sent to the regenerator for burning the coke to restore its activity and to generate heat which, transferred by the catalyst to the riser, will be utilized by the process.

The conditions prevailing at the point of introduction of the feed in the riser are decisive for the products that form in the reaction. In this region there is the initial mixing of the feed with the regenerated catalyst, heating of the feed up to the boiling point of its components and vaporization of the major portion of these components. The typical total residence time of the hydrocarbons in the riser is about 1 to 4 seconds.

For the reactions of catalytic cracking to take place, it is necessary for the vaporization of the feed in the region of mixing with the catalyst to take place rapidly, so that the vaporized hydrocarbon molecules can come in contact with the catalyst particles—whose size is about 70 micrometers—permeating through the mesopores and micropores of the catalyst, and reacting in the acid sites. Failure to achieve this rapid vaporization results in thermal cracking of the liquid fractions of the feed.

It is known that thermal cracking promotes the formation of by-products such as coke and fuel gas, principally in the cracking of residual feeds. The coke poisons the acid sites and may eventually block the pores of the catalyst. Therefore thermal cracking at the bottom of the riser competes undesirably with catalytic cracking, the purpose of the process.

Optimization of the conversion of the feed usually requires maximum removal of the coke from the catalyst in the regenerator. Combustion of the coke can take place in conditions of partial combustion or complete combustion.

In partial combustion, the gases produced by the combustion of the coke are mainly constituted of $CO_2$, CO and $H_2O$ and the content of coke in the regenerated catalyst is of the order of 0.1 to 0.3 wt. %. In complete combustion, carried out in the presence of a greater excess of oxygen, practically all the CO produced in the reaction is converted to $CO_2$.

The reaction of oxidation of CO to $CO_2$ is highly exothermic, with the result that complete combustion takes place with considerable release of heat, leading to very high regeneration temperatures. However, complete combustion produces catalyst containing less than 0.1 wt. % and, preferably less than 0.05 wt. % of coke, and is, in this respect, more advantageous than partial combustion, making up for a lower catalyst/oil ratio. The explanation for this fact is that complete combustion favours the regeneration of the catalyst and makes it more active, as well as avoiding the use of an expensive boiler for subsequent combustion of the CO.

The increase in coke in the spent catalyst results in an increase in combustion of coke in the regenerator per unit of mass of circulating catalyst. In conventional FCC units, the heat is removed from the regenerator via the combustion gas and more effectively by the stream of hot regenerated catalyst. An increase in the content of coke on the spent catalyst increases the temperature of the regenerated catalyst and the temperature difference between the regenerator and the reactor.

Therefore, a reduction in the flow of regenerated catalyst to the reactor, usually called catalyst circulation rate, is necessary in order to meet the thermal demand of the reactor and maintain the same reaction temperature. However, the lower catalyst circulation rate required by the larger temperature difference between the regenerator and the reactor results in reduction of the catalyst/oil ratio, decreasing the conversion, but also decreasing the deposition of coke on the catalyst, in contrast to the initial effect of increase in the content of coke.

Thus, the circulation of catalyst from the regenerator to the reactor is determined by the thermal demand of the riser and by the temperature that is established in the regenerator, which depends on the production of coke. As the coke produced in the riser is affected by said circulation of catalyst, it is concluded that the process of catalytic cracking functions in conditions of thermal balance, and, for the reasons stated, operation at very high regeneration temperature is undesirable.

As a rule, with the modern FCC catalysts, the temperatures of the regenerator, and therefore of the regenerated catalyst, are kept below 760° C., preferably below 732° C., as the loss of activity would be very severe above this value. The desirable operating range is from 685° C. to 710° C., The lower value is dictated primarily by the need to ensure proper combustion of the coke.

With the processing of heavier and heavier feeds, there is a tendency for the production of coke to increase and operation with complete combustion requires the installation of catalyst coolers to keep the temperature of the regenerator within acceptable limits. Generally, the catalyst coolers remove heat from a catalyst stream from the regenerator, returning a substantially cooled catalyst stream to this vessel.

Various works in the patent literature propose injecting auxiliary streams, such as water or other petroleum fractions, in the risers at a point above the point of injection of the principal feed to be cracked, with the objective of promoting an increase in mixture temperature in the region of feed injection, aiming to increase the percentage of the residual feeds vaporized, without altering the outlet temperature of the riser.

This approach is described in U.S. Pat. No. 4,818,372, which discloses an apparatus for FCC with temperature control that includes an ascending or descending reactor, device for introducing the hydrocarbon feed under pressure and in contact with a regenerated cracking catalyst, and at east one device for injecting an auxiliary fluid downstream of the reactor zone where the feed and the catalyst come in contact, by which it is claimed that a higher temperature is reached in the region of mixing of the feed with the catalyst. This patent uses an inert external fluid whose main effect is cooling of the region of injection of said fluid, with temperature control and increase in circulation of the catalyst.

According to the teaching in U.S. Pat. No. 4,818,372, separate injection of an external stream at an upper point of the riser is carried out for the purpose of controlling the temperature profile of the latter, so as to maintain the initial section of the riser at a relatively higher temperature without altering the temperature of the top of the riser (reaction temperature or TRX). This control can also be achieved by recycling heavy naphtha, as taught in U.S. Pat. No. 5,087,349.

With this same objective, U.S. Pat. No. 5,389,232 teaches recycling of heavy naphtha at upper points of the riser.

U.S. Pat. No. 4,764,268 suggests injecting a stream of LCO at the top of the riser with the aim of minimizing reactions of overcracking of naphtha.

A similar alternative, taught in U.S. Pat. No. 5,954,942, aims at an increase in conversion, by "quenching" or rapid cooling with an auxiliary stream of steam in the upper region of the riser.

Publication WO 93/22400 mentions the possibility of injection, along the riser, of a cracked product, such as LCO, with the aim of cooling the riser and consequently promoting an increase in circulation of catalyst and permitting improvement of the performance of additives based on ZSM-5. Bearing in mind the increase in demand for high-quality middle distillates, to the detriment of the market for gasoline, which is the main product of conventional FCC, changes in the mode of operation of the FCC unit have been discussed with the aim of increasing the output of LCO. Several technical articles discuss changes to the catalytic system and to the process variables, so as to achieve a reduction in the process severity, for the purpose of increasing the yield of middle fractions and reducing the content of aromatics in said fraction. The following are included, among the operating conditions:

reduction of the reaction temperature;

reduction of the catalyst/oil ratio;

reduction of catalytic activity.

All these measures aim to reduce the conversion, with consequent increase in the output of decanted oil.

Some important references on this subject are listed below.

a) "*Disillate yield from the FCC: process and catalyst changes for maximization of LCO*", Catalysts Courier, R. W. PETERMAN;

b) Hydrocarbon Publishing Company 2004, *"Advanced Hydrotreating and hydrocarbon technology to produce ultra 2-clean diesel fuel";* c) "*Studies on maximizing diesel oil production from FCC", Fifth international symposium on the advances in fluid catalytic cracking*, (218$^{th}$ National Meeting, American Chemical Society, 1999);

d) "*New development boosts production of middle distillate from FCC", Oil and Gas Journal* (August, 1970)".

LCO is one of the by-products of the FCC, representing from 15% to 25% of the yield and corresponding to the distillation range typically between 220° C. and 340° C. Normally the LCO has a high concentration of aromatics, even exceeding 80 wt. % of the total hydrocarbons present in said LCO fraction. In some situations it is beneficial to operate the FCC in such a way as to maximize the stream of LCO, and in this case it is desirable to incorporate the LCO in the pool of diesel oil. The high concentration of aromatics in LCO means that it has very poor knock characteristics in diesel engines (low cetane number) and high density. The high aromatics content also makes it difficult to improve its properties by hydrofining or desulphurization.

In the commonest form of operation for maximizing middle fractions in FCC, the reaction temperature is reduced to extremely low values (from 450° C. to 500° C.), circulation of catalyst is minimized and a catalyst of low activity is used. All these measures increase the yield and improve the quality (lower the aromatics content) of the LCO produced. The problem with this type of operation is that at the same time it promotes an increase in the residual fraction (340° C.+cut) in FCC, normally used for low-value fuel oil.

Operation at low temperatures in the post-riser region, which is a consequence of the low reaction temperature, as well as impairing the rectification efficiency of the catalyst, has the result that heavy fractions of the FCC product condense on the surface of the walls and internals of the reactor, leading to formation of coke on the walls of the separating vessel. The phenomenon of coke formation is a characteristic of reactors equipped with rapid separation systems, chiefly in units that process heavy Feeds. The formation of coke from fine films of condensate continues throughout the campaign of the unit, and commonly, at the end there are several tonnes of coke occupying a large proportion of the interior of the separating vessel.

This coke formation presents a serious risk of ignition and so must be removed completely before starting maintenance work on the unit, causing important losses for the refiner, owing to the delay in the timetable resulting from said removal. There is also the possibility of falling of this coke that has formed inside the separating vessel, during the campaign, which tends to block the flow of the catalyst, often leading to unscheduled shutdown of the unit. In both oases it causes loss of revenue.

U.S. Pat. No. 6,416,656 teaches a process for simultaneously increasing the yield of diesel and LPG. In this process, the gasoline is recracked to increase the yield of LPG, being injected at a point below the feed nozzle. The process feed is injected at multiple points along the riser, reducing the contact time and hence increasing the yield of LCO. However, the reduced severity of the FCC riser for middle distillates means that the cracking of naphtha in these conditions is not very effective.

Examination of the references cited shows that the literature neither discloses nor suggests, separately or in combination, the system and process characteristics resulting from the research conducted by the applicant, which led to the elaboration of the present application.

Advantageously, and differently from the prior art, the use of a dense-bed reactor operating with long catalyst-oil contact time combined with catalysts of low acidity or basic character endows the invention with the possibility of producing a middle distillate of low aromaticity, while operating the industrial unit at conventional FCC temperatures, thus avoiding all the problems arising from operation at low temperatures. Moreover, there is a result of conversion of bottoms similar to the values found in industrial units that operate with high values of process conversion.

More specifically, the invention relates to a process of catalytic cracking that employs catalytic systems of lower activity than that of the conventional catalytic systems, of reduced acidity or of basic character, that promote reaction mechanisms that modify the composition of the feed, converting it to lighter hydrocarbons, and making it possible to increase the production of saturated hydrocarbons in the cracked products. These catalytic systems are employed in a special reaction system and in appropriate operating conditions, so as to reach levels of conversion similar to those attained in the conventional processes of catalytic cracking and, at the same time, minimize the generation of aromatic hydrocarbons in the products.

Application of this process makes it possible to obtain a middle distillate of aromaticity below 5 wt. %, of $C_{10}/C_{11}$ aromatics, and therefore with suitable characteristics for incorporation in the diesel pool, after hydrofinishing or desulplhurization.

For realization of this objective, a dense-bed FCC reactor is used, which provides long contact times in the risers, in comparison with the conventional FCC process, in which the reactor has entrained-bed fluid dynamics. This guarantees a process conversion level similar to the levels processed in conventional FCC units, which use high-activity catalysts based on zeolite Y.

However, the big difference is the reduced production of aromatic hydrocarbons in the products, with application of this invention. As a result of combining the suitable catalytic system and the proposed process configuration, there is production of a stream of middle distillates with cetane number about 15 points higher than the typical cetane number of the LCO fractions produced in conventional FCC units and having a boiling point range similar to that of diesel. Moreover, the process produces a gasoline that can be used as petrochemical naphtha, after desulphurization.

The present invention offers solutions to a number of problems arising from the operation of FCC at low severity, as it operates with reaction temperatures similar to those employed in conventional FCC processes. In accordance with the concept of the invention, conditions of low severity mean a reaction temperature in the range from 460° C. to 520° C. In the case of heavy feeds, this range of reaction temperature results in a marked loss of rectification efficiency, with significant effects on the entrainment of hydrocarbons to the regenerator, and therefore on the heating of the latter. To this effect is associated the low thermal demand of the riser, resulting at a catalyst/oil ratio in the range from 3.0 to 6.0, increasing the output of decanted oil, along with cumulative increase in the temperature of the regenerator.

In the present invention, the reactor operates at temperatures normally employed in FCC units, increasing the process severity on the basis of the contact time and the catalyst/oil ratio. On combining this process conception with catalysts of low activity with reduced acidity or with basic character, it is possible to operate with high conversions and products with low aromaticity.

The stage of rectification of the spent catalyst, for removal of the residual hydrocarbons, has an efficiency similar to that achieved in conventional FCC units, since there is no need to operate the unit with moderate temperatures to reduce the severity.

Accordingly, the technique envisages a process for catalytic cracking of heavy feeds, in the absence of added hydrogen, using a dense-bed reactor, that operates with high catalyst/oil ratio and long contact times, producing a middle distillate of low aromaticity and low yield of decanted oil.

Said process employs catalysts that promote cracking reactions, while partially inhibiting the formation of aromatic molecules in the lighter products resulting from the reaction.

A patent published recently: WO 2007/082629, also for the purpose of maximization of LCO and reduction of aromatics in the products generated in the FCC process, describes the use of catalysts which, on the basis of their characteristics, could be applied in the present invention. However, in said published patent, the process preferably takes place in two stages, where the first stage employs mild operating conditions of low severity and the second uses conventional zeolitic FCC catalyst. Accordingly, to achieve high conversion in the process it is necessary to install two FCC units with conventional hardware, i.e. with cracking reactions in risers.

In contrast to the aforementioned publication, the present invention provides a process that performs the entire conversion in a single stage, based on the use of a dense-bed reactor. Furthermore, the operating conditions adopted are considered to be of high severity in comparison with the processes that maximize middle distillates, as the proposed invention employs high catalyst/oil ratios and extremely long contact times.

Accordingly, the present invention proposes an alternative that is economically more attractive and gives excellent results in terms of yield and quality, according to the example given in the document. To summarize, the proposed invention envisages the use of only one catalytic system of low activity in a process with only one stage operating with an extended contact time, a combination not foreseen in the literature.

The overall result of the process according to the present invention is an increase in the yield of middle distillates of low aromaticity and petrochemical naphtha, said process and equipment used for carrying out said process being described and claimed in the present application.

SUMMARY OF THE INVENTION

The present invention relates to an FCC process for the production of middle distillates of low aromaticity that comprises the following stages:

a) submitting a feed consisting of heavy fractions of hydrocarbons, such as a heavy vacuum gas oil, or an atmospheric residue, or a mixture thereof in any proportions, to a reaction of fluid catalytic cracking, in the absence of added hydrogen, in the riser of a dense-bed FCC reactor, operated:
   (i) at temperatures that vary in the range from 520° C. to 560° C., preferably around 540° C.
   (ii) using a cracking catalyst of low activity, of reduced acidity or of basic character;
   (iii) at a catalyst/oil ratio in the range from 8 to 15, preferably 10, and
   (iv) with a contact time in the range from 30 to 120 seconds, preferably in the range from 70 to 90 seconds;
b) withdrawing the effluent obtained in the above reaction at the top of the dense-bed catalytic cracking reactor, submitting it to fractionation in a fractionating tower that produces a gas fraction that is sent to a gas recuperation section, plus a light naphtha fraction and a middle distillate, both of low aromaticity, and sending these for subsequent treatment and sale.

The invention also relates to equipment that comprises a riser ending in a dense-bed FCC reactor where a reaction of fluid catalytic cracking is carried out, in the absence of added hydrogen, producing the effluent which, after it has been fractionated in a fractionating tower, generates the middle distillate of low aromaticity which, after it has been desulphurized, can be incorporated in the diesel pool and the naphtha fraction, also of low aromaticity which, after being separated in a stabilizers tower, and desulphurized, can be sold as petrochemical naphtha.

Additionally, the naphtha fraction can be sent to the conventional FCC unit where it undergoes recracking to produce a high-octane gasoline.

BRIEF DESCRIPTION OF THE DRAWINGS

The FCC process and equipment for production of middle distillates of low aromaticity and high-octane gasoline, according to the present invention, will now be described in detail, based on the diagrams referred to below, which are an integral part of the present specification.

DETAILED DESCRIPTION OF THE INVENTION

For better understanding, the FCC process for production of middle distillates of low aromaticity, according to the present invention, will be described in detail referring to the diagrams, according, to the identification of the respective components.

Figure 1:
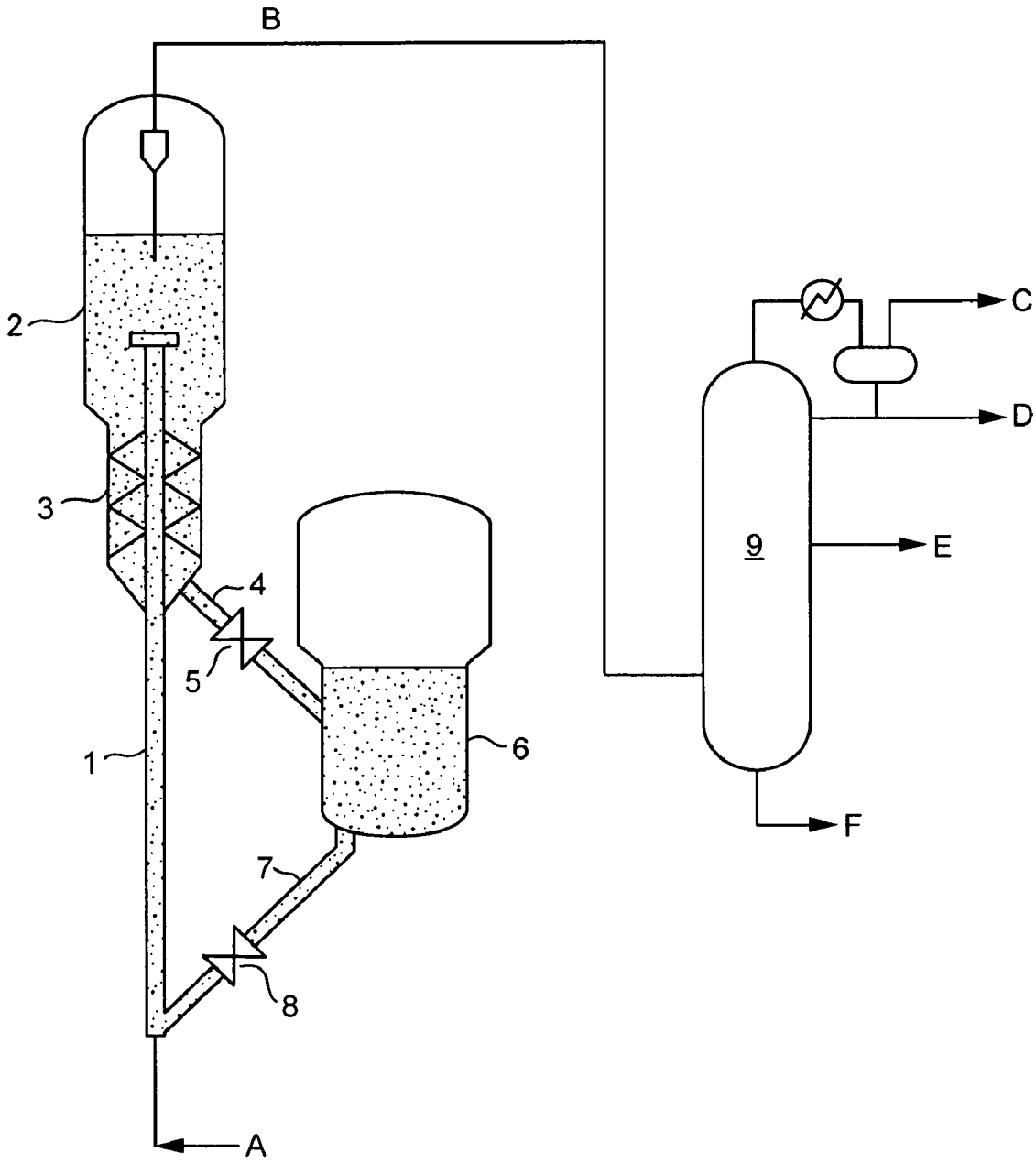
FIG. 1 shows a simplified schematic representation of equipment to be used for carrying out the process of the present invention.

FIG. 1 shows a simplified schematic representation of the present invention, comprising a dense-bed FCC unit into which a feed A is injected at the bottom of the riser (1), consisting of fractions of the HVGO or ATR type, or a mixture of the two in any proportions, at a controlled injection temperature in the range from 150° C. to 300° C. The reaction temperature is controlled in the range from 520° C. to 560° C., and is preferably maintained around 540° C. The mixture of hydrocarbons and catalyst travels through the riser (1) and is discharged into the dense-bed FCC reactor (2), where the cracking reactions continue in the dense bed. The catalyst/oil ratio in the reactor varies in the range from 8 to 15, preferably 10, and the contact time between the catalyst and the hydrocarbons in the assembly of riser (1) and dense-bed FCC reactor (2) can vary between 30 and 120 seconds, but should preferably be maintained in the range from 70 to 90 seconds.

From the vessel of the dense-bed FCC reactor (2), the catalyst flows directly to the rectifier (3) in the annular region of the lower portion of the vessel and from there, following steam rectification, the catalyst is sent to the regenerator, through a pipe (4). The level of the catalyst bed in reactor (2) is controlled by a valve (5). The catalyst from the regenerator is recycled to the riser (1) via a pipe (7), the flow of catalyst in pipe (7) being controlled by a valve (8).

In these conditions the dense-bed FCC reactor (2) produces an effluent B, which, after fractionation in the fractionating tower (9), generates a gas fraction C, which is sent to the gas recuperation section, a light naphtha D which, after it has been desulphurized, can be sold as petrochemical naphtha, a middle distillate of low aromaticity E which, after desulphurization, can be incorporated in the diesel pool, and a bottom product F, normally intended for fuel oil.

The temperature of the catalyst in the rectifier (3) is around 540° C., which is typical of conventional operations, allowing rectification of high efficiency and eliminating the drawbacks of rectification at low severity.

The temperature of the bed in the regenerator (6) is preferably adjusted to a temperature range from 685° C. to 710° C., by appropriate control of the temperature of the feed for the dense-bed reactor in the range from 150° C. to 300° C.

The invention also includes another aspect that relates to the use of a low-activity cracking catalyst of reduced acidity, or of basic character, that minimizes the production of aromatics in comparison with conventional FCC catalysts. The low catalytic activity of the catalyst is characterized in that it provides conversions of typical FCC feeds of, at most, 40% also in operating conditions typical of FCC, at a catalyst/oil ratio of about 10, reaction temperature of 540° C. and contact time between feed and catalyst of less than 10 seconds. The catalyst recommended in the present invention must have a low concentration or preferably be free from acidic zeolites in the protic form or exchanged with rare earths, usually employed as the main active ingredient of conventional FCC catalysts. The catalytic composition suitable for the invention can include the other components of the matrix of an FCC catalyst such as oxides and hydroxides of aluminium and/or silicon, as well as clays to impart suitable physical properties to the catalyst, whose acidity and activity can be adjusted by lixiviation and/or doping with alkali metals, alkaline earths, trivalent metals or transition metals. Optionally, other materials with basic characteristics or of low protic acidity such as hydroxides and oxides of transition metals, mixed derivatives of hydroxides and oxides, cationic and anionic clays, phosphates, hydroxy-phosphates and silica-alumina phosphates, doped or treated thermally and/or chemically, can also constitute or be incorporated in the catalytic composition required for the invention, it being, however, important to avoid the presence of components that promote dehydrogenating activity. The catalyst of the present invention as defined promotes the formation of saturated hydrocarbons to the detriment of aromatics, as its low activity is compensated by a longer contact time between the catalyst and feed during the cracking reaction without significantly promoting an increase in the aromatics content of the products.

The present invention will now be illustrated with an example, which should not, however, be regarded as limiting it, but only has the aim of demonstrating that the objectives of the invention were achieved in full.

EXAMPLE

A conventional zeolitic catalyst designated "A" and another non-zeolitic catalyst of low activity designated "B", as recommended in the present invention, underwent comparative tests using gas oil feed typical of Brazilian petroleum (Table 1) in a fluidized-bed unit, a stirred reactor of the CREC type (of LASA, H. I. (1992)—U.S. Pat. No. 5,102,628), suitable for kinetic studies and that permits, by its design characteristics, operation with extended residence times. The catalyst is charged in the reaction chamber and kept fluidized with ascending motion by an impeller rotating at high speed. When the reactor is in the desired reaction conditions the feed is injected and the required reaction time is reached, after which the products are discharged and analysed by gas chromatography. A constant catalyst/feed ratio of about 10 was used in the experiments presented here. A conventional FCC catalyst "A", suggested by the manufacturer for operation to maximize middle fractions (LCO) in the FCC process, was tested at a temperature of 480° C. recommended for this application, being lower than the temperature employed in normal operation of greater severity for maximization of gasoline. This is the reference case.

The case that is intended to illustrate the scope of the present invention used catalyst "B", a mixed aluminium-magnesium oxide with basic characteristics and relatively low cracking activity, at the reaction temperature typical of conventional FCC, 540° C.

Figure 2:
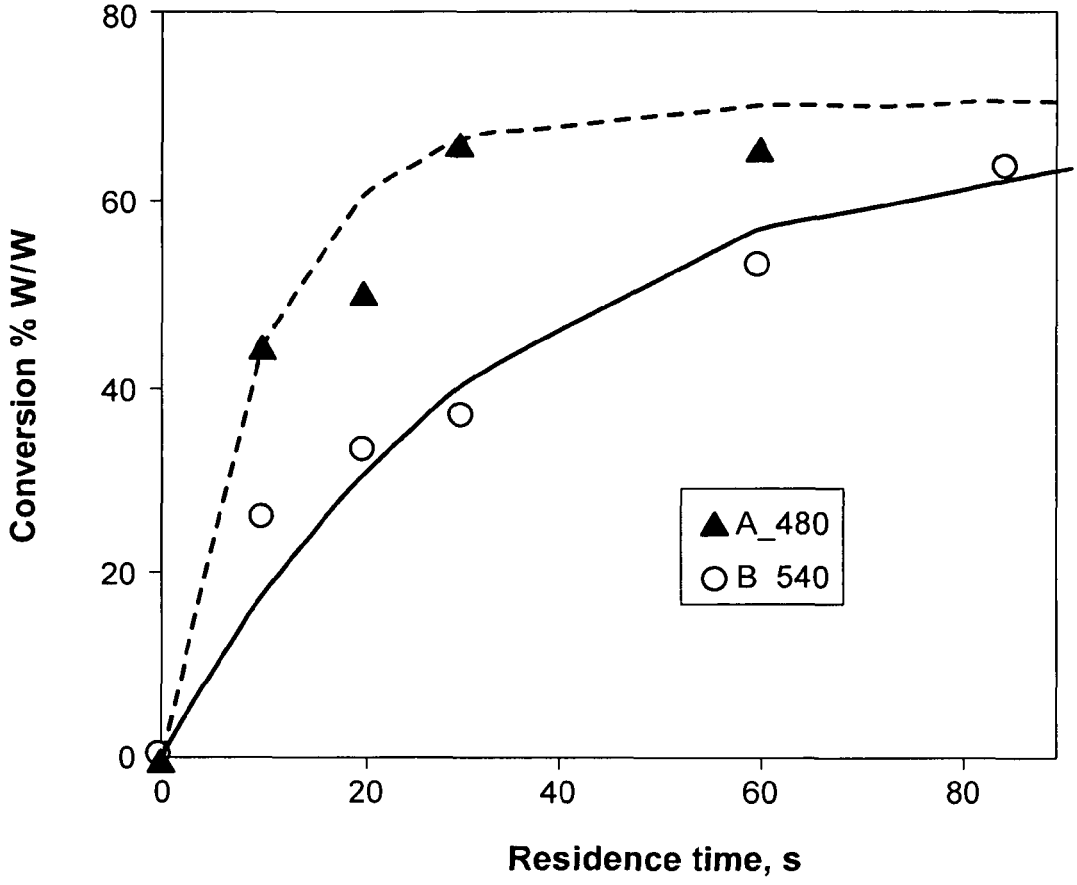
FIG. 2 shows a graph with comparative data for conversion between a conventional FCC process and the process of the present invention.
Figure 3:
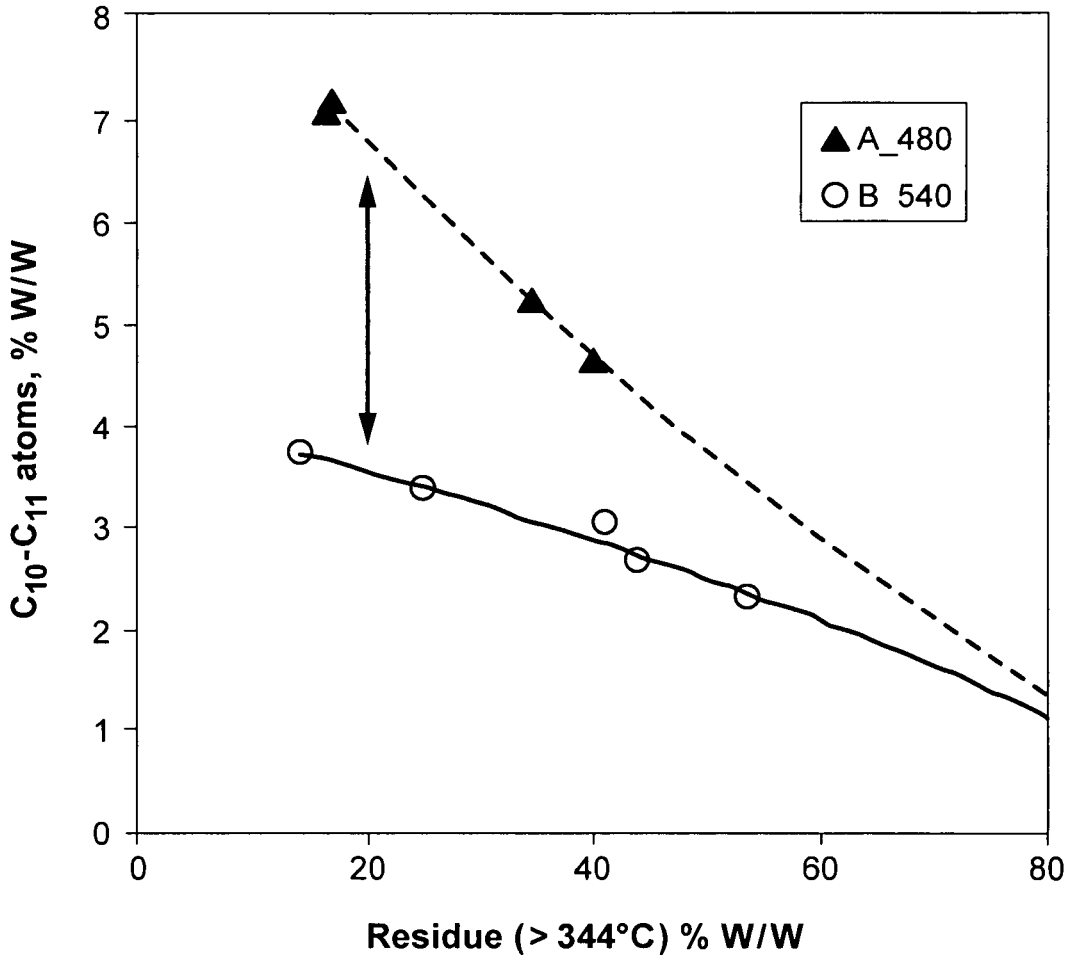
FIG. 3 shows a graph with comparative data for the results obtained for aromatics content in the fraction of middle distillates between the conventional FCC process and the process of the present invention.

As can be seen from FIG. 2, on applying the sufficient residence time, the system recommended in the present invention is able to reach levels of conversion similar to those of the reference case, as well as similar yields of middle tractions. However, as shown in FIG. 3, for the same conversion or the same yield of bottoms/residue, the resultant aromatics content in the middle fractions ($C_{10}$-$C_{11}$) is significantly lower in the case of the system recommended for the present invention, thus demonstrating the clear advantage of the process of the invention.

TABLE 1

| MARLIN - REPLAN PETROLEUM | RESULTS |
|---|---|
| Density at 20/4° C. | 0.9519 |
| ° API | 16.5 |
| Viscosity at 60° C. (ASTM D 455); cSt. | 107 |
| Viscosity at 82.2° C. (ASTM D 455), cSt. | 35.06 |
| Viscosity at 100° C. (ASTM D 455), cSt. | 17.72 |
| Refractive index at 70° C. (ASTM D 1774) | 1.5135 |
| Sulphur (ASTM D 5354), ppm | 7116 |
| Distillation (ASTM D 97) ° C. | |
| IBP | 291.1 |
| 5% | 355.8 |
| 10% | 381.4 |
| 30% | 430.5 |
| 50% | 460.6 |
| 70% | 493.7 |
| 90% | 535.3 |
| 95% | 555.8 |

TABLE 1-continued

| MARLIN - REPLAN PETROLEUM | RESULTS |
|---|---|
| FBP | 621.1 |
| Ramsbottom Carbon Residue (ASTM D 524), wt. % | 1.23 |
| Aniline point (ASTM D 611) ° C. | 72.5 |
| Total Nitrogen (Antek), ppm | 3246 |
| Basic Nitrogen (UOP 269), ppm | 1307 |
| HPLC/SFC, wt. % | |
| Saturated compounds | 51.1 |
| Monoaromatics | 18.3 |
| Diaromatics | 18.9 |
| Triaromatics | 8.1 |
| Polyaromatics | 3.6 |

The invention claimed is:

1. A method of fluid catalytic cracking for production of middle distillates of low aromaticity, characterized in that it comprises the following steps:

a) submitting a feed A, consisting of heavy fractions of hydrocarbons, such as a heavy vacuum gas oil, or an atmospheric residue, or a mixture thereof in any proportions, to a reaction of fluid catalytic cracking, in the absence of added hydrogen, in the riser of a dense-bed FCC reactor, operated:
   (i) at temperatures that vary in the range from 520° C. to 560° C.;
   (ii) using a cracking catalyst of low activity, of reduced acidity or of basic character;
   (iii) at a catalyst/oil ratio in the range from 8 to 15, and
   (iv) with a contact time of the feed A with the cracking catalyst in the range from 30 to 120 seconds;

b) withdrawing an effluent B obtained in the above reaction at the top of the dense-bed catalytic cracking reactor, submitting it to fractionation in a fractionating tower that produces a gas fraction C, which is sent to a gas recuperation section, plus a light naphtha fraction D, and a middle distillate E, both of low aromaticity, and sending these for subsequent treatment and sale.

2. The method according to claim 1, characterized in that the low catalytic activity of the catalyst is limited to a conversion of the FCC feed of at most 40%, under operating conditions typical of FCC with a catalyst/oil ratio of about 10, reaction temperature of 540° C. and feed-catalyst contact time less than 10 seconds.

3. The method according to claim 1, characterized in that the following are used as cracking catalysts (i) catalysts having low catalytic activity, reduced acidity or basic character comprising low concentration or no acidic zeolites in the protic form or exchanged with rare earths, in addition being formulated with other components of a matrix typical of an FCC catalyst as well as clays, whose acidity and activity can be adjusted by lixiviation and/or doping with alkali metals, alkaline-earth metals, trivalent metals or transition metals and (ii) the catalysts formulated with other materials that possess basic characteristics, or low protic acidity, mixed derivatives of hydroxides or oxides, cationic and anionic clays, phosphates, hydroxy-phosphates and silica-alumina phosphates, doped or treated thermally and/or chemically.

4. The method according to claim 1, wherein effluent B comprises aromatics ($C_{10}$ and $C_{11}$) below 5 wt. %.

5. The method according to claim 1, wherein the temperature is around 540° C.

6. The method according to claim 1, wherein the catalyst/oil ratio is 10.

7. The method according to claim 1, wherein the contact time ranges from 70 to 90 seconds.

* * * * *